US005134023A

United States Patent [19]

Hsu

[11] Patent Number: 5,134,023

[45] Date of Patent: Jul. 28, 1992

[54] PROCESS FOR MAKING STABLE FIBERBOARD FROM USED PAPER AND FIBERBOARD MADE BY SUCH PROCESS

[75] Inventor: Wu-Hsiung E. Hsu, Orleans, Canada

[73] Assignee: Forintek Canada Corp., Ottawa, Canada

[21] Appl. No.: 548,527

[22] Filed: Jul. 5, 1990

[51] Int. Cl.[5] ..... D04H 1/58

[52] U.S. Cl. ..... 428/288; 264/83; 264/109; 264/115; 264/120; 428/280; 428/903.3

[58] Field of Search ..... 264/83, 109, 115, 120; 428/280, 281, 903.3, 288

[56] References Cited

U.S. PATENT DOCUMENTS

| | | | |
|---|---|---|---|
| 1,198,028 | 9/1916 | Harden . | |
| 2,224,135 | 12/1940 | Boehm | 92/2 |
| 2,317,394 | 4/1943 | Mason | 92/39 |
| 2,812,252 | 11/1957 | Baymiller | 92/3 |
| 3,021,244 | 2/1962 | Meiler | 156/30 |
| 3,087,837 | 4/1963 | Van Loo | 428/280 |
| 3,533,906 | 10/1970 | Reiniger | 162/13 |
| 3,736,221 | 5/1973 | Evers et al. | 161/170 |
| 3,769,116 | 10/1973 | Champeau | 156/62.8 |
| 3,837,989 | 9/1974 | McCoy | 161/68 |
| 3,880,975 | 4/1975 | Lundmark | 264/119 |
| 3,919,017 | 11/1975 | Shoemaker et al. | 156/62.2 |
| 3,956,541 | 5/1976 | Pringle | 428/2 |
| 4,012,561 | 3/1977 | Doughty et al. | 428/531 |
| 4,046,952 | 9/1977 | Shoemaker et al. | 428/423 |
| 4,111,730 | 9/1978 | Balatinecz | 156/62.2 |
| 4,153,488 | 5/1979 | Wiegand | 428/280 |
| 4,158,712 | 6/1979 | Degeno | 428/280 |
| 4,162,877 | 7/1979 | Nyberg | 425/84 |
| 4,230,049 | 10/1980 | Horne | 428/903.3 |
| 4,349,325 | 9/1982 | Mair | 428/438 |
| 4,379,808 | 4/1983 | Cole et al. | 428/438 |
| 4,382,847 | 5/1983 | Akesson et al. | 428/438 |
| 4,410,573 | 10/1983 | Narymskaya et al. | 428/403.3 |
| 4,497,662 | 2/1985 | Chisholm et al. | 428/430 |
| 4,503,115 | 3/1985 | Hemels et al. | 428/281 |
| 4,605,467 | 8/1986 | Bottger | 156/497 |
| 4,751,034 | 6/1988 | DeLong et al. | 264/115 |

FOREIGN PATENT DOCUMENTS

| | | |
|---|---|---|
| 703105 | 2/1965 | Canada . |
| 964569 | 3/1975 | Canada . |
| 161766 | 11/1985 | European Pat. Off. . |

*Primary Examiner*—James J. Bell
*Attorney, Agent, or Firm*—Stanley E. Johnson

[57] ABSTRACT

Used paper and paper products are recycled into fiberboard formed under conditions of pressure, heat and injection of steam under pressure for sufficient time to render the fiberboard dimensionally stable.

13 Claims, No Drawings

PROCESS FOR MAKING STABLE FIBERBOARD FROM USED PAPER AND FIBERBOARD MADE BY SUCH PROCESS

FIELD OF INVENTION

This invention relates to a process for making fiberboard from paper, used paper, magazines, paper products and the like and fiberboard made by such process. Paper, used paper and/or fine paper and the like is recycled into construction panels and furniture panels which have good dimensional stability by reducing them into a dry, fluffy fiberous mass and if necessary reducing the moisture content to approximately 7% or less, blending the dry, fluffy fiberous mass with a resin binder, including wax and other additives if desired, forming the fiberous mass and resin into a mat and forming the mat into a fiberboard panel under heat, pressure and high pressure steam.

BACKGROUND OF INVENTION

Since the late 1960's there has been increasing concern about the manner in which municipal solid wastes are collected and disposed of and because of increased environmental concerns recycling now has global attention. Problems and costs associated with the disposal of the solid waste have begun to alarm the consumers, producers and politicians. Some attempts to reduce the wastes by recycling have been initiated recently. However, no completely satisfactory way to recycle all types of waste paper have been found as yet.

Paper and paperboard waste is found to be the largest among the municipal solid wastes. In the U.S. it ranged from 24.5 million tons disposed in 1960 to 49.4 million tons disposed in 1984, and is projected to be 65.1 million tons in the year 2000. The paper share of the municipal waste stream has ranged from 30% in 1960 to 37.1% in 1984, and is projected to be 41% in the year 2000. Most of the municipal solid waste is currently disposed of in landfills. However, available landfill space is rapidly decreasing and landfill costs are increasing. Uses for the municipal solid wastes, especially paper and paperboard must be found. Ideally, they should be converted from a negative value residue into a revenue generating product or even value-added products. Since paper and paperboard waste has the largest share of municipal solid waste, attempts must be taken to reduce it.

Pressure is being applied on the pulp industry by regulatory authorities to recycle newspaper. This however involves substantial costs, making the industry hesitant because it may be more expensive to recycle than producing pulp from wood chips. Some of the costs for recycling involve collection, transport and providing facilities capable of performing the recycling tasks including de-inking. De-inking has to be done with solvents resulting in another stream of pollutant which is environmentally unfriendly. For this and many other reasons the industry is reluctant to recycle used newspaper. As far as fine paper is concerned, there is little, if any, recycling done at the present time because of the additives in fine paper.

Paper is mainly made from pulp produced from wood chips in which the lignin and hemicelluloses have been removed. With the lignin and hemicelluloses removed, there is no self-bonding properties remaining for use in the formation of fiberboard. Moreover, due to the absence of the lignin and hemicellulose and also the absence of fiber structure and reduced fiber length, products made therefrom heretofore have lacked resistance to water and moisture and also lack wet strength properties. Because of this, paper and the like products have not been considered a suitable raw material for fiberboard manufacture.

Some proposals have been made to recycle newspaper into building products as discussed for example in the teachings of U.S. Pat. No. 3,736,221 issued May 29, 1973 to K. W. Evers, et al and U.S. Pat. No. 4,111,730 issued Sep. 5, 1978 to J. J. Balatinecz.

Evers, et al discloses subjecting dry waste paper of all sorts such as newspaper, magazines, pamphlets, books, shipping cartons, fiberboard and the like to the action of a hammermill thereby comminuting it to "virtually individual fibers", mixing the resultant with a binder such as polyvinylchloride, urea-formaldehyde resin or phenolic resins and subjecting the same to a pressure of about 6000 psi and then baking the compressed mixture at about 250 degrees fahrenheit for six to eight hours. The resultant product is indicated as having a density of about 40 pounds per cubic foot, can be sawed into different shapes, will receive nails and screws and does not easily chip or crack and is thus considered suitable for construction. However, this known technique is a slow and time consuming process and involves costly equipment. By way of example, a press for a 4'×8' panel would have to have a capacity of approximately 28 000 tons in order to exert a panel forming pressure of 6000 psi as called for in the prior art teaching.

Balatinecz discloses breaking waste paper up into fragments, examples of which are indicated as being strips one quarter to one half inch wide and in lengths of three to fourteen inches. A binder such as phenolformaldehyde is used to adhere the flakes together and the panel is formed by subjecting the resin coated paper flakes to a pressure of 150 to 1000 psi at a temperature in the range of about 200 to 450 degrees fahrenheit. The paper flakes are said to be conditioned to a moisture content from 6% to 12% by weight of total dry paper before being blended with the resin binder.

These known and patented procedures do not, however, provide panels that are resistant to moisture and thus do not display good dimensional stability. This is yet another reason why panels formed from recycled paper have not hitherto met with commercial success.

There are different proposals for making manufactured composite board resistant to moisture giving the panel dimensional stability. One such proposal is found in the teachings of U.S. Pat. No. 3,919,017 issued Nov. 11, 1975 to P. D. Shoemaker et al. The process involves bonding cellulosic materials under conditions of elevated pressure and temperature using a particular binder system. The patentee speculates cross-linking occurs between the cellulosic material and the binder system under the conditions of elevated pressure and temperature. The patentee teaches using particles of wood or other cellulosic material defined as including "any material substantially formed from cellulose including natural material such as comminuted wood, vegetable fibers such as straw, corn stalks and other cellulosic materials such as pulp, shreaded paper and the like".

What takes place chemically, when treating wood, is a complex and complicated field and while one can speculate theoretically what might happen it is impossible to say precisely what might be occurring. Other proposals in the formation of composite wood products involves subjecting resin coated wood particles to steam and pressure and heat which may be done on a moving bed for the product as taught by U.S. Pat. No. 4,605,467 issued Aug. 12, 1986 to F. Bottger, or in a single mold (effectively a batch system), as taught in U.S. Pat. No. 4,162,877 issued Jul. 31, 1979 to D. W. Nyberg.

Other patents of interest are as follows.

U.S. Patents in Common

U.S. Pat. No. 1,198,028 issued Sep. 12, 1916 to G. W. W. Harden
U.S. Pat. No. 4,012,561 issued Mar. 15, 1977 to J. B. Doughty, et al
U.S. Pat. No. 2,812,252 issued Nov. 5, 1957 to J. W. Baymiller
U.S. Pat. No. 3,956,541 issued May 11, 1976 to J. P. Pringle
U.S. Pat. No. 4,046,952 issued Sep. 6, 1977 to P. D. Shoemaker
U.S. Pat. No. 4,349,325 issued Sep. 14, 1982 to W. J. Mair
U.S. Pat. No. 4,497,662 issued Feb. 5, 1985 to D. M. Chisholm, et al
U.S. Pat. No. 4,382,847 issued May 10, 1983 to Dave Akesson
U.S. Pat. No. 4,379,808 issued Apr. 12, 1983 to J. N. Cole, et al
U.S. Pat. No. 4,751,034 issued Jun. 14, 1988 to E. A. Delong, et al
U.S. Pat. No. 2,224,135 issued Dec. 10, 1940 to R. M. Boehm
U.S. Pat. No. 2,317,394 issued Apr. 27, 19434 to W. H. Mason, et al
U.S. Pat. No. 3,533,906 issued Oct. 13, 1970 to H. M. Reiniger
U.S. Pat. No. 3,021,244 issued Feb. 13, 1962 to J. G. Meiler
U.S. Pat. No. 3,880,975 issued Apr. 29, 1975 to L. E. Lundmark
U.S. Pat. No. 3,837,989 issued Sep. 24, 1974 to W. W. McCoy
U.S. Pat. No. 3,769,116 issued Oct. 30, 1973 to C. A. Champaeu German Patents 892,415 Oct. 8, 1953
935,502

European Patent 0161766 published Nov. 21, 1985 K. C. Shen

SUMMARY OF INVENTION

An object of the present invention is to provide a simple process for making dimensionally stable, water resistant fiberboard using pulp in the form of paper particularly previously used paper, newspaper, magazines, paper products and the like and the product obtained by such process.

The present invention particularly provides a means of recycling paper such as newspaper, magazines and the like including fine paper into stable and durable fiberboards which can be used as furniture and construction materials. Bonding or cross-linking is believed to occur between the cellulosic fibers, which is depleted of lignin and hemicelluloses, and components of the resin binder during steam pressing. These bonding properties have been found to be enhanced by steam pressing in the presence of moisture and excess formaldehyde from resin used in the board manufacture.

In the present invention, cellulosic material only is used and by such term herein reference is being made to wood or the like products wherein the lignin and hemicelluloses have been removed. The final formed product contains at least 60% of such material by dry weight basis. In the preferred form, the cellulosic material is used newspaper and includes fine paper which may have additives such as clay and resins and the like.

Depending upon the availability of equipment, paper, used paper and paper products are converted into fiber bundles by a hammermill, an attrition mill or any type suitable refiner or defiberator. The resulting product is a fluffy chewed up mass of cellulosic material essentially free, as mentioned, from lignin and hemicellulose. This loose mass of fibers is then, if required, dried to a preferred moisture content of, say, 5% to 7% when used with a powdered resin binder or, say, 3% to 5% in the case of using a liquid resin binder.

In the case of using a liquid resin binder, it normally would be added to the cellulose mass, whereafter drying would take place. The desired moisture content is preferably 5% or even less, and the drying can be done either before or after blending with resin binder, wax or other additives.

The fiberous mass, with the resin added thereto, is next formed into a mat by vacuum drawing or the like and pre-pressed by rollers, belts or the like to reduce the thickness. The so formed mat is then hot pressed in a steam press with steam injected at high pressure during the press cycle. The press is heated to a temperature in the range of 325 degrees fahrenheit (166 degrees centigrade) to 430 degrees fahrenheit (220 degrees centigrade) depending upon the resin being used for binding the cellulosic fibers. The temperature will be on the low side of this temperature range for urea-formaldehyde, isocyanate, melamine-formaldehyde, fortified urea-formaldehyde binders and on the high side for phenol-formaldehyde binders.

Steam is introduced in a pressure range of 80 psi to 200 psi preferrably at a temperature below the mold or press temperature. To have the temperature of the steam above the platen temperature, would result in unwanted condensation. Saturated or partially dry steam is used and the steaming takes place for a duration of at least one minute above 130 degrees centigrade for low temperature curing resins, and for at least one minute above at least 150 degrees centigrade for high temperature curing resins, such as phenol-formaldehyde. The steam pressure should be at least 80 psi, and the steam has to be retained in the mat as long as possible so that the internal mat temperature is raised to at least 150 degrees centigrade.

A steam press suitable for carrying out applicant's method is disclosed in U.S. Pat. No. 4,850,849 issued Jul. 25, 1989 to the present applicant, the disclosure of which patent is incorporated herein by reference thereto.

I have found that steam injection is essential and necessary for making dimensionally stable fiberboard from used paper fibers. It is believed that the bonding properties between fibers are enhanced by crosslinking hydroxy group of cellulose with formaldehyde, which is normally associated with phenol-formaldehyde or urea-formaldehyde resin, at high pressure steam. The cross-linking is believed to be as follows:

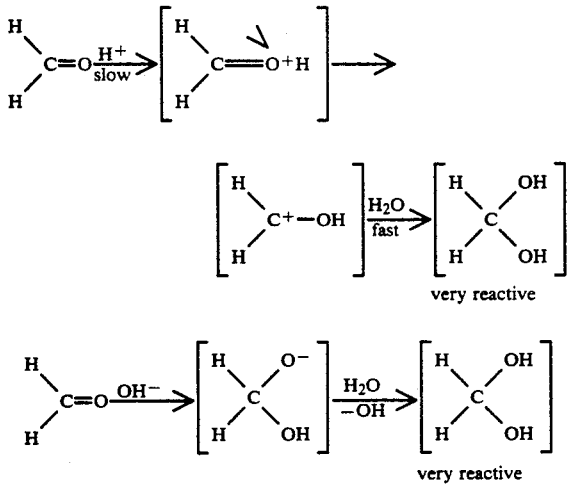

When steam is injected, the temperature in the mat is rapidly increased so that the water and formaldehyde will convert into a gas phase. The potential energy is higher in the gas phase than in the liquid phase, and the kinetic energy is increased with increasing temperature. Therefore, the activation energy of water and formaldehyde is higher for steam pressing than for conventional hot pressing, and thus forms dihydroxymethane faster. Dihydroxymethane is very unstable, but very reactive and can react with cellulose as follows:

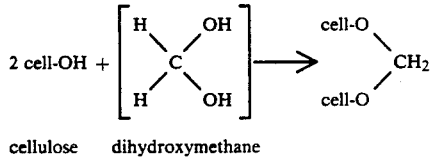

Consequently, the possibility of crosslinking between cellulose molecules are higher in steam pressing than conventional hot pressing. Of course, steam pressing enables cellulose to plasticize more than it does when undergoing conventional hot pressing and thus only minimum internal stresses will be induced during pressing, i.e., minimum springback will occur after the products absorbs moisture and water.

As a result, fiberboard made with the present invention has been found to be highly stable. For example, it is easy to achieve, that at a specific gravity over 0.720, the irreversible thickness swelling of fiberboard made from papers which is lower than 5%, and as opposed to over 30% for conventional fiberboard after an extensive period of soaking (e.g. 7 days) and redrying.

A sample board constructed in accordance with the present invention has been tested and found to have a 16% equilibrium moisture content in an environment of 90% relative humidity at a temperature of 21 degrees centigrade. A conventionally producted board in the same environmental conditions reaches an equilibrium moisture content of 19%.

The term cellulosic material as used herein means pulp and the like that is essentially depleted of lignin and hemicellulose. Fiberboards provided by applicant's process herein contain at least 60% of fibers on a dry weight basis from such source and are bonded by a resin binder under heat, high pressure steam and pressure.

The fiberboards of the present invention can be made to most any size dependant upon the equipment available and most any density depending upon the degree of compression. By way of example, the boards produced may have a low density in the range of 15 to 20 pounds per cubic foot, or a high density, in the range of approximately 70 pounds per cubic foot. Where the adhesive is urea-formaldehyde, the formed boards or panels are cooled and then stacked. In the case where the adhesive is phenol-formaldehyde, the formed boards are removed from the press and stacked while hot.

According to my invention I have been able to repeatably produce a stable fiberboard made from fibers (essentially lignin and hemicellulose free cellulose) derived from paper or paper products and bonded using a resin binder under heat pressure and injection of steam under high pressure that is dimensionally stable. The fiberboard contains at least 60% dry weight basis of essentially the lignin and hemicellulose free fibers the remainder of the constituents being resin, wax, fillers, carbon black from ink on newspaper and clays and other fillers commonly found in fine paper or other types of fibers such as synthetic or wood fibers with lignin and hemicellulose present therein. It is not known at the present time but it is believed that mechanical pulp (which includes lignin and hemicellulose therein) and cardboards which also includes some lignin and hemicellulose in the fibers may also provide a dimensionally stable fiberboard product using the present method of using pressure and steam under high pressure to form the board. Steam is injected into the mat at, at least 80 psi, and retained in the mat as long as possible to raise the mat temperature to at least 150 degrees centigrade. By way of example, phenol-formaldehyde resin is normally present in the amount of 2% to 10% by weight, and a wax in the amount of about 1% to 2%.

I claim:

1. A process for making fiberboard comprising:
(a) subjecting paper, used paper and paper products and the like to the action of a hammermill, fiberator, refiner or the like to provide a loose fluffy mass of cellulosic fibers that are essentially free of lignin and hemicellulose;
(b) forming a mixture by mixing a resin binder with a material containing at least 60% percent of said mass on a dry weight basis, said binder being selected from the group comprising urea-formaldehyde, malamine-formaldehyde, phenol-formaldehyde, isocyanate;
(c) forming said mixture into a mat;
(d) precompressing said mat to a selected thickness;
(e) heating said pre-compressed mat to a temperature in the range of 166 degrees centigrade to 220 degrees centigrade; and
(f) subjecting said heated and pre-compressed mat to steam at a pressure in the range of 80 psi to 200 psi for a period of at least one minute at a temperature exceeding 130 degrees centigrade and removing the formed fiberboard from the steam press.

2. A fiberboard produced by the method of claim 1 having a specific gravity of at least 0.720.

3. A process as defined in claim 1 wherein said compressed mat is subjected to steam and pressure in a steam press.

4. A process as defined in claim 1 wherein said precompressed mat is placed in a steam press and heated to a temperature in the range of 166 degrees centigrade to 220 degrees centigrade whereafter steam is introduced into the steam press at a temperature above at least 130 degrees fahrenheit and at a pressure in the range of 80 psi to 200 psi.

5. A method of manufacturing a product comprising essentially lignin and hemicellulose free cellulosic material and a resinous binder comprising:

(a) providing a loose fluffy mass of essentially lignin and hemicellulose free material;

(b) mixing said loose fluffy mass of material with a resin binder selected from the group comprising urea-formaldehyde, isocyanate, melamine-formaldehyde, fortified urea-formaldehyde and phenol-formaldehyde;

(c) consolidating the mixed mass to a selected density by applying pressure; and (d) subjecting the consolidated mass to steam, heat and pressure for a period of time and at a temperature sufficient to cure the resin and render the formed panel dimensionally stable.

6. A method as defined in claim 5 wherein said binder is phenol-formaldehyde.

7. A method as defined in claim 5 comprising confining said consolidated mass in the cavity of a steam press and injecting steam into said cavity at a pressure in the range of 80 to 200 psi.

8. A fiberboard panel made by the method of claim 5.

9. A method of recycling newspaper, magazines, fine paper and used paper products into fiberboard panels consisting essentially of:

(a) subjecting paper from said sources to the action of a hammermill or equivalent to provide a loose fluffy mass of cellulosic material essentially free of lignin and hemicellulose;

(b) mixing a quantity of said fluffy mass with a resin binder selected from the group comprising urea-formaldehyde, malamine-formaldehyde, phenol-formaldehyde, isocyanate;

(c) drying said mixture, if necessary, to a moisture content that does not exceed 5%;

(d) forming said mixture into a mat;

(e) precompressing said mat to a pre-selected thickness;

(f) placing said precompressed mat in a steam press and applying pressure to provide a desired density of the fiberboard panel being formed;

(g) heating said mat in the press to a temperature in the range of 166 degrees centigrade to 220 degrees centigrade; and (h) injecting steam into the steam press at a pressure of at least 80 psi and a temperature less than the press temperature for sufficient time as to cure the adhesive and render the formed panel dimensionally stable.

10. A fiberboard panel produced in accordance with the method of claim 9.

11. A method of making a fiberboard panel comprising:

(a) reducing previously used paper, cardboard, fine paper and the like to a loose fluffy mass;

(b) mixing said loose fluffy mass with a resin binder selected from the group comprising urea-formaldehyde, isocyanate, melamine-formaldehyde, fortified urea-formaldehyde and phenol-formaldehyde;

(c) consolidating said mixture into a mat of selected thickness;

(d) placing said consolidated mat into a steam press and applying heat, pressure and injecting steam for a period of time and at a pressure sufficient to cure the resin and render the formed panel dimensionally stable by at least in part cross-linking the cellulose component of the recycled paper and a component of the resin.

12. A method as defined in claim 11 wherein said loose fluffy mass contains at least 60% essentially lignin and hemicellulose free cellulose on a dry weight basis.

13. A method as defined in claim 12 wherein the consolidated mass is placed in a steam press and subjected to a pressure to provide a selected thickness to the board formed therefrom, heating said pressed mass to a temperature in the range of 166 degrees centigrade to 220 degrees centigrade and injecting steam into the press at a pressure in the range of 80 to 200 psi.

* * * * *